US005840663A

United States Patent [19]

Nibert et al.

[11] Patent Number: 5,840,663

[45] **Date of Patent: *Nov. 24, 1998**

[54] POWER TRANSMITTING FLUIDS IMPROVED ANTI-SHUDDER DURABILITY

[75] Inventors: Roger K. Nibert, Hampton; Manoj Tandon, Princeton; Raymond F. Watts, Long Valley, all of N.J.

[73] Assignee: Exxon Chemical Patents Inc., Linden, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 768,843

[22] Filed: Dec. 18, 1996

[51] Int. Cl.[6] ..... C10M 141/10

[52] U.S. Cl. ..... 508/291; 508/294; 508/401; 508/441; 252/78.5; 252/75

[58] Field of Search ..... 508/291, 290, 508/294, 401, 441; 252/78.5, 75

[56] References Cited

U.S. PATENT DOCUMENTS

| | | | |
|---|---|---|---|
| 4,752,416 | 6/1988 | Scharf et al. | 252/78.5 |
| 4,938,880 | 7/1990 | Waddoups et al. | 508/294 |
| 5,156,654 | 10/1992 | Koch et al. | 508/291 |
| 5,185,090 | 2/1993 | Ryer et al. | 508/432 |
| 5,242,612 | 9/1993 | Ryer et al. | 508/432 |
| 5,358,650 | 10/1994 | Srinivasan et al. | 508/194 |
| 5,384,055 | 1/1995 | Ashjian | 508/291 |
| 5,403,501 | 4/1995 | Schwind | 508/186 |

*Primary Examiner*—Jerry D. Johnson

[57] ABSTRACT

The anti-shudder durability of power transmitting fluids, particularly automatic transmission fluids, is improved by incorporating a combination of low potency friction modifiers, alkyl phosphites, specific ashless dispersants and a corrosion inhibitor. The anti-shudder durability of these fluids may be further enhanced by inclusion of a metallic detergent.

16 Claims, No Drawings

POWER TRANSMITTING FLUIDS IMPROVED ANTI-SHUDDER DURABILITY

This invention relates to a composition and a method of improving the anti-shudder durability of power transmitting fluids, particularly automatic transmission fluids (ATFs).

The continuing search for methods to improve overall vehicle fuel economy has identified the torque converter, or fluid coupling, used between the engine and automatic transmission, as a relatively large source of energy loss. Since the torque converter is a fluid coupling it is not as efficient as a solid disk type clutch. At any set of operating conditions (engine speed, throttle position, ground speed, transmission gear ratio), there is a relative speed difference between the driving and driven members of the torque converter. This relative speed differential represents lost energy which is dissipated from the torque converter as heat.

One method of improving overall vehicle fuel economy used by transmission builders is to build into the torque converter a clutch mechanism capable of "locking" the torque converter. "Locking" refers to eliminating relative motion between the driving and driven members of the torque converter so that no energy is lost in the fluid coupling. These "locking" or "lock-up" clutches are very effective at capturing lost energy at high road speeds. However, when they are used at low speeds vehicle operation is rough and engine vibration is transmitted through the drive train. Rough operation and engine vibration are not acceptable to drivers.

The higher the percentage of time that the vehicle can be operated with the torque converter clutch engaged, the more fuel efficient the vehicle becomes. A second generation of torque converter clutches have been developed which operate in a "slipping" or "continuously sliding mode". These devices have a number of names, but are commonly referred to as continuously slipping torque converter clutches. The difference between these devices and lock-up clutches is that they allow some relative motion between the driving and driven members of the torque converter, normally a relative speed of 50 to 500 rpm. This slow rate of slipping allows for improved vehicle performance as the slipping clutch acts as a vibration damper. Whereas the "lock-up" type clutch could only be used at road speeds above approximately 50 mph, the "slipping" type clutches can be used at speeds as low as 25 mph, thereby capturing significantly more lost energy. It is this feature that makes these devices very attractive to vehicle manufacturers.

Continuously slipping torque converter clutches impose very exacting friction requirements on automatic transmission fluids (ATF's) used with them. The fluid must have a very good friction versus velocity relationship, i.e., friction must always increase with increasing speed. If friction decreases with increasing speed then a self-exciting vibrational state can be set up in the driveline. This phenomenon is commonly called "stick-slip" or "dynamic frictional vibration" and manifests itself as "shudder" or low speed vibration in the vehicle. Clutch shudder is very objectionable to the driver. A fluid which allows the vehicle to operate without vibration or shudder is said to have good "anti-shudder" characteristics. Not only must the fluid have an excellent friction versus velocity relationship when it is new, it must retain those frictional characteristics over the lifetime of the fluid, which can be the lifetime of the transmission. The longevity of the anti-shudder performance in the vehicle is commonly referred to as "anti-shudder durability". It is this aspect of performance that this invention addresses.

It has previously been found that certain compounds made by reacting isomerized alkenyl substituted succinic anhydrides (and their saturated alkyl analogs) with polyamines, when used with oil-soluble phosphorus compounds, and optionally, overbased metallic detergents, provide a unique solution to the problem of extending anti-shudder durability.

What we have now found is that by careful selection of the oil-soluble phosphorus compound, ashless dispersant and a corrosion-inhibitor, that fluids with significantly improved anti-shudder durability can be produced.

SUMMARY OF THE INVENTION

This invention relates to a composition and method of improving the anti-shudder durability of a power transmitting fluid comprising:

(1) a major amount of a lubricating oil; and (2) an anti-shudder improving effective amount of an additive combination comprising:

(a) a reaction product of an isomerized alkenyl substituted succinic anhydride and a polyamine characterized by structure (I), where structure (I) is:

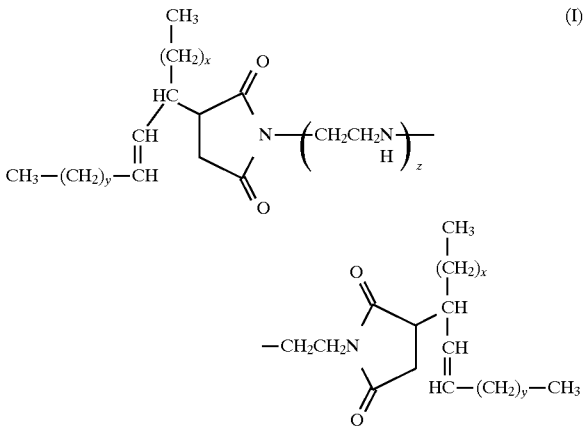

(I)

where:

x and y are independent integers whose sum is from 1 to 30, and z is an integer from 1 to 10;

(b) an oil-soluble alkyl phosphite (c) an ashless dispersant with alkyl side chains of greater than 1500 molecular weight; and (d) a nitrogen containing corrosion inhibitor, and (e) optionally, a metallic detergent which is a salt of an alkali, or alkaline earth metal.

Another embodiment of this invention is when structure (I) contains the saturated alkyl analogs of the isomerized alkenyl substituted groups.

DETAILED DESCRIPTION OF THE INVENTION

We have found that fluids containing combinations of the compound of structure (I) and oil-soluble alkyl phosphites in conjunction with specific ashless dispersants, not only provide excellent fresh oil friction versus velocity characteristics, but that these characteristics, are retained for as much as 10 times as long as those found in conventional automatic transmission fluids. The anti-shudder durability of these fluids can be further improved by optionally incorporating overbased metallic detergents.

While the invention is demonstrated for a particular power transmitting fluid, i.e., an ATF, it is contemplated that the benefits of this invention are equally applicable to other power transmitting fluids. Examples of other types of power transmitting fluids included within the scope of this invention are gear oils, hydraulic fluids, heavy duty hydraulic fluids, industrial oils, power steering fluids, pump oils, tractor fluids, universal tractor fluids, and the like. These power transmitting fluids can be formulated with a variety of performance additives and in a variety of base oils.

Increasing the anti-shudder durability of an ATF is a very complex problem. Although it appears that a simple solution would be to merely increase the amount of conventional friction modifier in the fluid, this is not feasible because simply increasing the concentration of conventional friction modifiers, significantly reduces the overall level of friction exhibited by the fluid. Reduction of friction coefficients below certain minimum levels is undesirable since the holding capacity, or static capacity, of all the clutches in the transmission is thereby reduced, making these clutches prone to slip during vehicle operation. Slipping of the shifting clutches must be avoided, as these clutches will be destroyed by unwanted slipping.

Low Potency Friction Modifiers—Structure (I)

The starting components for forming the structure (I) compounds are isomerized alkenyl succinic anhydrides which are prepared from maleic anhydride and internal olefins i.e., olefins which are not terminally unsaturated and therefore do not contain the

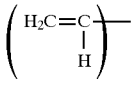

moiety. These internal olefins can be introduced into the reaction mixture as such, or they can be produced in situ by exposing alpha-olefins to isomerization catalysts at high temperatures. A process for producing such materials is described in U.S. Pat. No. 3,382,172. The isomerized alkenyl substituted succinic anhydrides have the structure shown as structure (II):

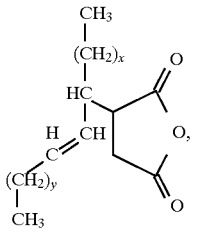

(II)

where x and y are independent integers whose sum is from 1 to 30.

The preferred succinic anhydrides are produced from isomerization of linear alpha-olefins with an acidic catalyst followed by reaction with maleic anhydride. The preferred alpha-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. Preferably x+y is from 13 to 15. The most preferred materials for this invention are those made from 1-tetradecene (x+y=9), 1-hexadecene (x+y=11) and 1-octadecene (x+y=13), or mixtures thereof.

The isomerized alkenyl succinic anhydrides are then further reacted with polyamines of structure (III), where structure (III):

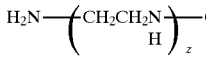

(III)

where z is an integer from 1 to 10, preferably from 1 to 5, most preferably from 1 to 3.

These are common polyethylene amines. When z=1 the material is diethylene triamine, when z=2 the material is triethylene tetramine, when z=3 the material is tetraethylene pentamine, for products where z>3 the products are commonly referred to as 'polyamine' or PAM. The preferred products of this invention employ diethylene triamine, triethylene tetramine, tetraethylene pentamine or mixtures thereof.

The isomerized alkenyl succinic anhydrides (II) are typically reacted with the amines in a 2:1 molar ratio so that both primary amines are predominantly converted to succinimides. Sometimes a slight excess of isomerized alkenyl succinic anhydride (II) is used to insure that all primary amines have reacted. The products of the reaction are shown as structure (I).

The di-succinimides of structure (I) may be further post-treated by any number of techniques known in the art. These techniques would include, but not be limited to: boration, maleation, acid treating with inorganic acids such as phosphoric, phosphorous, and sulfuric. Descriptions of these processes can be found in, for example, U.S. Pat. No. 3,254,025; U.S. Pat. No. 3,502,677; U.S. Pat. No. 4,686,054; and U.S. Pat. No. 4,857,214.

Another useful derivative of the low potency friction modifiers are where the isomerized alkenyl groups of structures (I) and (II) have been hydrogenated to form their saturated alkyl analogs. These saturated versions of structures (I) and (II) may likewise be post-treated as previously described.

While any effective amount of the compounds of structure (I) and its derivatives may be used to achieve the benefits of this invention, typically these effective amounts will range from 0.5 to 10, preferably from 2 to 7, most preferably from 3 to 6 weight percent of the finished fluid.

Examples for producing the structure (I) compounds of the present invention are given below. These examples are intended for illustration and the invention is not limited to the specific details set forth.

PREPARATIVE EXAMPLES

Example FM-1

Into a one liter round bottomed flask fitted with a mechanical stirrer, nitrogen sweep, Dean Starke trap and condenser was placed 352 gm (1.00 mole) of iso-octadecenylsuccinic anhydride (ODSA from Dixie Chemical Co.). A slow nitrogen sweep was begun, the stirrer started and the material heated to 130° C. Immediately, 87 gm (0.46 moles) of commercial tetraethylene pentamine was added slowly through a dip tube to the hot stirred iso-octadecenylsuccinic anhydride. The temperature of the mixture increased to 150° C. where it was held for two hours. During this heating period 8 ml. of water (~50% of theoretical yield) were collected in the Dean Starke trap. The flask was cooled to yield the product. Yield: 427 gm. Percent nitrogen: 7.2.

Example FM-2

The procedure of Example A was repeated except that the following materials and amounts were used: iso-octadecenylsuccinic anhydride, 458 gm (1.3 moles), and;

diethylenetriamine, 61.5 gm (0.6 m). The water recovered was 11 ml. Yield: 505 gm. Percent nitrogen: 4.97.

Example FM-3

The procedure of Example A was repeated except that the following materials and amounts were used: iso-hexadecenylsuccinic anhydride (ASA-100 from Dixie Chemical Co.), 324 gm (1.0 mole), and; tetraethylenepentamine, 87 gm, 0.46 mole). The water recovered was 9 ml. Yield: 398 gm. Percent nitrogen: 8.1.

Example FM-4

The product of Example A, 925 gm (1.0 mole), and 300 gm of a naphthenic base oil (EXXON Necton 37) were placed in a 2 liter flask fitted with a heating mantle, an overhead stirrer, nitrogen sweep and condenser. The temperature of the mixture was raised to 80° C., the stirrer started and a nitrogen sweep begun. To this hot solution maleic anhydride, 98 gm (1.0 mole), was added slowly over about 20 minutes. Once the addition was complete the temperature was raised to 150° C. and held for 3 hours. The product was cooled and filtered. Yield: 1315 gm. Percent nitrogen: 5.2%.

Example FM-5

The product of Example A, 925 gm (1.0 mole), and 140 gm of a naphthenic base oil (EXXON Necton 37) and 1 gm of DC-200 anti-foamant were placed in a 2 liter round bottomed flask fitted with a heating mantle, an overhead stirrer, nitrogen sweep, Dean Starke trap and condenser. The solution was heated to 80° C. and 62 gm (1.0 mole) of boric acid was added. The mixture was heated to 140° C. and held for 3 hours. During this heating period 3 ml. of water were collected in the Dean Starke trap. The product was cooled and filtered. Yield: 1120 gm. Percent nitrogen: 6.1; percent boron: 0.9

Alkyl Phosphites

The alkyl phosphites useful in this invention are the mono-, di- and tri-alkyl phosphites shown as structures (IV), (V) and (VI) respectively. They are represented by the structures shown:

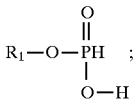

(IV)

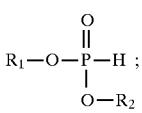

(V)

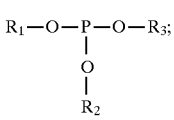

(VI)

where:

The R groups are C4 to C30 hydrocarbyl or substituted hydrocarbyl. R can also vary independently, they can be alkyl or aryl, they may be substituted by hetero atoms such as S, N, or O. The alkyl groups may be linear or branched, the aryl groups may be phenyl or substituted phenyl. The R groups may also be saturated or unsaturated. In the structures above it is also allowed that one oxygen linking group may be replaced by a sulfur atom. The preferred phosphites are mixtures of the three types of alkyl phosphites, IV, V and VI. The most preferred are mixtures of mono- (IV) and di-alkyl phosphites (V). The R groups are preferably linear alkyl groups, such as octyl, decyl, dodecyl, tetradecyl and octadecyl. Most preferred are alkyl groups containing thioether linkages. Examples of these groups are 3-thio-heptane, 3-thio-nonane, 3-thio-undecane, 3-thio-tridecane, 5-thio-hexadecane, 8-thio-octadecane. The most preferred alkyl-phosphites of this invention are the thio-alkyl phosphites as described in U.S. Pat. Nos. 5,185,090 and 5,242,612 which are incorporated herein by reference.

While any effective amount of the alkyl phosphite may be used to achieve the benefits of this invention, typically these effective amounts will contribute to the finished fluid from 10 to 1000, preferably from 100 to 750, most preferably from 200 to 500 parts per million (ppm) of phosphorus.

Preparative Examples

Example P-1

A phosphorus- and sulfur-containing reaction product mixture was prepared by placing in a round bottom 4-neck flask equipped with a reflux condenser, a stirring bar and a nitrogen bubbler, 246 grams (1 mole) of hydroxyethyl-n-dodecyl sulfide, 122 grams (1 mole) of thiobisethanol, and 194 grams (1 mole) of dibutyl phosphite. The flask was flushed with nitrogen, sealed and the stirrer started. The contents were heated to 95° C. under vacuum (−60 KPa). The reaction temperature was maintained at 95° C. until approximately 59 mls of butyl alcohol were recovered as overhead in a chilled trap. Heating was continued until the TAN of the reaction mixture reached about 110. This continued heating took approximately 3 hrs, during which time no additional butyl alcohol was evolved. The reaction mixture was cooled and 102 grams of Exxon Necton-37 baseoil added. The final product contained 5.2% phosphorus and 11.0% sulfur.

Example P-2

A phosphorus- and sulfur-containing reaction product mixture was prepared by placing in around bottom 4-neck flask equipped with a reflux condenser, a stirring bar and a nitrogen bubbler, 190 grams (1 mole) of hydroxyethyl-n-octyl sulfide, 154 grams (1 mole) of dithiodiglycol, and 194 grams (1 mole) of dibutyl phosphite. The flask was flushed with nitrogen sealed and the stirrer started. The contents were heated to 105° C. under vacuum (−90 KPa). The reaction temperature was maintained at 105° to 110° C. until approximately 54 mls of butyl alcohol were recovered as overhead in a chilled trap. Heating was continued until the TAN of the reaction mixture reached about 70. This continued heating took approximately 3 hrs, during which time no additional butyl alcohol was evolved. The reaction mixture was cooled and analyzed for phosphorus and sulfur. The final product contained 6.4% phosphorus and 19.7% sulfur.

Example P-3

A phosphorus- and sulfur-containing reaction product mixture was prepared by placing in a round bottom 4-neck flask equipped with a reflux condenser, a stirring bar and a nitrogen bubbler, 194 grams (1 mole) of dibutyl phosphite. The flask was flushed with nitrogen, sealed and the stirrer started. The dibutyl phosphite was heated to 150° C. under vacuum (−90 KPa). The temperature in the flask was maintained at 150° C. while 190 grams (1 mole) of hydroxyethyl-n-octyl sulfide was added over about one hour. During the addition approximately 35 mls of butyl alcohol were recovered as overhead in a chilled trap. Heating was continued for about one hour after the addition of the hydroxyethyl-n-octyl sulfide was completed, during which time no additional butyl alcohol was evolved. The reaction mixture was cooled and analyzed for phosphorus and sulfur. The final product had a TAN of 115 and contained 8.4% phosphorus and 9.1% sulfur.

Ashless Dispersant

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos.: 3,018,247; 3,018,250; 3,018,291; 3,361,673 and 4,234,435. Mixed ester-amides of hydrocarbyl-substituted succinic acids are described, for example, in U.S. Pat. Nos.: 3,576,743; 4,234,435 and 4,873,009. Mannich dispersants, which are condensation products of hydrocarbyl-substituted phenols, formaldehyde and polyamines are described, for example, in U.S. Pat. Nos.: 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. Nos.: 3,275,554; 3,438,757; 3,454,55 and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine. Low cost poly (ethyleneamines) (PAM's) averaging about 5 to 7 nitrogen atoms per molecule are available commercially under trade names such as "Polyamine H", "Polyamine 400","Dow Polyamine E-100", etc. Hydroxy-substituted amines include N-hydroxyalkyl-alkylene polyamines such as N-(2-hydroxyethyl)ethylene diamine, N-(2-hydroxyethyl) piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

The amine is readily reacted with the selected hydrocarbyl-substituted dicarboxylic acid material, e.g., alkylene succinc anhydride, by heating and oil solution containing 5 to 95 wt. % of said hydrocarbyl-substituted dicarboxylic acid material at about 100° to 250° C., preferably 125° to 175° C., generally for 1 to 10, e.g., 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition, having a functionality of 1.6, derived from reaction of polyolefin and maleic anhydride; i.e., preferably the pentamine is used in an amount sufficient to provide about 0.4 equivalents (that is, 1.6 divided by (0.8×5) equivalents) of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art. (see, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 1500 to 5000 (preferably 1800 to 3000). It has been found that selecting certain dispersants within the broad range of alkenyl succinimides produces fluids with unexpectedly improved anti-shudder durability. The preferred dispersants are those produced by reacting polyisobutenylsuccinic anhydride with polyamines. The most preferred dispersants of this invention are those wherein the polyisobutene substituent group has a molecular weight of greater than approximately 2000 atomic mass units and where the basic nitrogen containing moiety is polyamine (PAM).

The ashless dispersants of the invention can be used in any effective amount. However, they are typically used from about 0.1 to 10.0 mass percent in the finished lubricant, preferably from about 0.5 to 7.0 percent and most preferably from about 2.0 to about 5.0 percent.

Preparative Examples

Example D-1

Preparation of Polyisobutylene Succinic Anhydride

A polyisobutenyl succinic anhydride having a succinic anhydride (SA) to polyisobutylene mole ratio (i.e., a SA:PIB ratio) of 1.04 is prepared by heating a mixture of 100 parts of polyisobutylene (940 Mn; Mw/Mn=2.5) with 13 parts of maleic anhydride to a temperature of about 220° C. When temperature reaches 120° C., the chlorine addition is begun and 10.5 parts of chlorine at a constant rate are added to the hot mixture for about 5.5 hours. The reaction mixture is then heat soaked at 220° C. for about 1.5 hours and then stripped with nitrogen for about one hour. The resulting polyisobutenyl succinic anhydride has an ASTM Saponification Number of 112. The PIBSA product is 90 wt. % active ingredient (A.I.), the remainder being primarily unreacted PIB.

Preparation of Dispersant

Into a suitable vessel equipped with a stirrer and nitrogen sparger are placed 2180 gms (approximately 2.1 moles) of the PIBSA produced above and 1925 grams of Exxon solvent 150 neutral oil. The mixture is stirred and heated under a nitrogen atmosphere. When the temperature reaches 149° C. 200 grams (approximately 1.0 mole) of Dow E-100 polyamine is added to the hot PIBSA solution over approximately 30 minutes. At the end of the addition a subsurface nitrogen sparge is begun and continued for an additional 30 minutes. When this stripping operation is complete, i.e. no further water is evolved, the mixture is cooled and filtered. The product contains 1.56% nitrogen.

Boration of Dispersant

One kilogram of the above produced dispersant is placed in a suitable vessel equipped with a stirrer and nitrogen sparger. The material is heated to 163° C. under a nitrogen atmosphere and 19.8 grams of boric acid are added over one hour. After all of the boric acid has been added a subsurface nitrogen sparge is begun and continued for 2 hours. After the 2 hour sparge the product is cooled and filtered to yield the borated dispersant. The product contains 1.5% nitrogen and 0.35% boron.

Example D-2

Preparation of Polyisobutylene Succinic Anhydride

A polyisobutenyl succinic anhydride having a SA:PIB ratio of 1.13 is prepared by heating a mixture of 100 parts of polyisobutylene (2225 Mn; Mw/Mn=2.5) with 6.14 parts of maleic anhydride to a temperature of about 220° C. When the temperature reaches 120° C., the chlorine addition is begun and 5.07 parts of chlorine at a constant rate are added to the hot mixture for about 5.5 hours. The reaction mixture is then heat soaked at 220° C. for about 1.5 hours and then stripped with nitrogen for about one hour. The resulting polyisobutenyl succinic anhydride has an ASTM Saponification Number of 48. The PIBSA product is 88 wt. % active ingredient (A.I.), the remainder being primarily unreacted PIB.

Preparation of Dispersant

Into a suitable vessel equipped with a stirrer and nitrogen sparger are placed 4090 gms (approximately 1.75 moles) of the PIBSA produced above and 3270 grams of Exxon solvent 150 neutral oil. The mixture is stirred and heated under a nitrogen atmosphere. When the temperature reaches 149° C. 200 grams (approximately 1.0 mole) of Dow E-100 polyamine is added to the hot PIBSA solution over approximately 30 minutes. At the end of the addition a subsurface nitrogen sparge is begun and continued for an additional 30 minutes. When this stripping operation is complete, i.e. no further water is evolved, the mixture is cooled and filtered. The product contains 0.90% nitrogen.

Boration of Dispersant

One kilogram of the above produced dispersant is placed in a suitable vessel equipped with a stirrer and nitrogen sparger. The material is heated to 163° C. under a nitrogen atmosphere and 13.0 grams of boric acid are added over one hour. After all of the boric acid has been added, a subsurface nitrogen sparge is begun and continued for 2 hours. After the 2 hour sparge the product is cooled and filtered to yield the borated dispersant. The product contains 0.88% nitrogen and 0.23% boron.

Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025, 3,502,677 and 4,857,214).

In order to produce a homogeneous product, it may be desirable to pre-mix or pre-contact at elevated temperatures the low potency friction modifiers and/or the dispersant with the alkyl phosphites. Optionally, other additives which do not interfere with producing the homogeneous product are included. Typical elevated temperatures range from 60° to 200° C., preferably from 75° to 175° C., and most preferably from 100° to 150° C.

Corrosion Inhibitors

The corrosion inhibitors of the invention are of two types (1) the benzotriazoles of Structure VII and (2) the alkyl dithiothiadiazoles of Structure VIII. The corrosion inhibitors reduce the corrosion of metals such as copper. They are also referred to in the literature as metal deactivators or metal passivators. The corrosion inhibitors useful in the invention are nitrogen and/or sulfur containing heterocyclic compounds such as triazoles, aminomercaptothiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof.

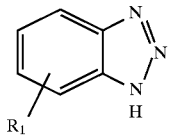

VII

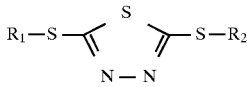

VIII

The benzotriazoles useful in this invention are shown as Structure VII where $R_1$ is $C_1$ to $C_{20}$ hydrocarbyl or substituted hydrocarbyl. $R_1$ may be linear or branched, it may be saturated or unsaturated. It may contain ring structures that are alkyl or aromatic in nature. $R_1$ may also contain heteroatoms such as N, O or S. The corrosion inhibitor of Structure VII comprises at least one triazole which may be substituted or unsubstituted. Examples of suitable compounds are benzotriazole, alkyl-substituted benzotriazoles (e.g. tolyltriazole, ethylbenzotriazole, hexylbenzotriazole, octylbenzotriazole, etc.), aryl substituted benzotriazole and alkylaryl- or arylalkyl-substituted benzotriazoles. Preferably, the triazole is a benzotriazole or an alkylbenzotriazole in which the alkyl group contains from 1 to about 20 carbon atoms, preferably 1 to about 8 carbon atoms. Benzotriazole and tolyltriazole are particularly preferred.

The substituted thiadiazoles useful in the present invention are compounds of Structure VIIl produced from the 2,5-dimercapto-1,3,4-thiadiazole (DMTD) molecule (Structure VIII, $R_1$=$R_2$=H). Many derivatives of DMTD have been described in the art, and any such compounds can be included in the compositions of the present invention. The preparation of DMTD derivatives has been described in E.K. Fields "Industrial and Engineering Chemistry", 49, p. 1361–4 (September 1957).

U.S. Pat. Nos. 2,719,125; 2,719,126 and 3,087,937 describe preparation of various 2,5-bis-(hydrocarbon dithio)-1,3,4-thiadiazoles. The hydrocarbon group may be aliphatic or aromatic, including cyclic, alicyclic, aralkyl, aryl and alkaryl. Such poly sulfides can be represented by Structure VIII, $R_1$=R—$(S)_x$—; $R_2$=R'—$(S)_y$—; wherein R and R' may be the same or different hydrocarbon groups, x and y are integers from 0 to about 8, and the sum of x and y is at least 1. A process for preparing such derivatives is described in U.S. Pat. No. 2,191,125. U.S. Pat. No. 3,087,932 describes a one-step process for preparing 2,5-bis-(hydrocarbyidithio) -1,3,4-thidiazoles. The procedure involves the reaction of either DMTD or its alkali metal or ammonium salt and a mercaptan in the presence of hydrogen peroxide and solvent. U.S. Pat. Nos. 2,749,311 and 3,087,932 are hereby incorporated by references for their description of DMTD derivatives which can be utilized as part of the invention.

Also useful in the invention are other derivatives of DMTD. They would include the carboxylic esters wherein $R_1$ and $R_2$ are joined to the sulfide sulfur through a carbonyl group, i.e. R—C(O)—. Preparation of these thioester containing DMTD derivaties is described in U.S. Pat. No. 2,760,933 which is incorporated herein by reference. DMTD derivatives produced by condensation of DMTD with alpha-halogenated aliphatic monocarboxylic carboxylic acids having at least 10 carbon atoms is described in U.S. Pat. No. 2,836,564 which is incorporated herein by reference. This process produces DMTD derivatives wherein $R_1$ and $R_2$ are HOOC—CH(R)—. DMTD derivatives further produced by amidation or esterification of these terminal carboxylic acid groups are also useful.

The preparation of 2-hydrocarbyldithio-5-mercapto-1,3, 4-thiadiazoles characterized by Structure VIII, wherein $R_1$=R'—S— and $R_2$=H is described in U.S. Pat. No. 3,663, 561. The compositions are prepared by the oxidative coupling of equimolar portions of a hydrocarbyl mercaptan and DMTD or its alkali metal mercaptide. The compositions are reported to be excellent in preventing copper corrosion. The mono-mercaptans used in the preparation of the compounds are represented by the formula:

R'SH wherein R' is a hydrocarbyl group containing from 1 to about 250 carbon atoms. A peroxy compound, hypohalide or air, or mixtures thereof can be utilized to promote the oxidative coupling. Specific examples of the mono-mercaptan include, for example, methyl mercaptan, isopropyl mercaptan, hexyl mercaptan, octyl mercaptan, decyl mercaptan and long chain alkyl mercaptans. U.S. Pat. No. 3,663,561 is hereby incorporated by references for its identification of DMTD derivatives which are useful in this invention.

A preferred class of DMTD derivatives are the mixtures of the 2-hydrocarbyidithio-5-mercapto-1,3,4-thiadiazoles and the 2,5-bis-hydrocarbyidithio -1,3,4-thiadiazoles. These mixtures are prepared as described above except that more than one, but less than two, mole of alkyl mercaptan are used per mole of DMTD. Such mixtures are sold under the name Hitec 4313.

The corrosion inhibitor can be used in any effective amount, however, typically the concentration in the finished lubricant would be from about 0.001 to about 5.0 mass percent, preferably from about 0.005 to about 3.0 mass percent and most preferably from about 0.01 to about 1.0 mass percent.

Metallic Detergents

The metal-containing detergents of the compositions of this invention are exemplified by oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkyl phenols, (6) organic phosphorus acids characterized by at least one direct carbon-to-phosphorus linkage. Such organic phosphorus acids include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium and magnesium. The preferred salts useful with this invention are either neutral or overbased salts of calcium or magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° to 200° C.

Examples of suitable metal-containing detergents include, but are not limited to, neutral and overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, have sometimes been called, simply, neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See for example, the disclosures of U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; 4,965,004.

Preferred metallic detergents for use with this invention are overbased sulfurized calcium phenates, overbased calcium sulfonates, and overbased magnesium sulfonates.

While any effective amount of the metallic detergents may be used to enhance the benefits of this invention, typically these effective amounts will range from 0.01 to 2.0, preferably from 0.05 to 1.0, most preferably from 0.05 to 0.5 weight percent in the finished fluid.

Other additives known in the art may be added to the power transmitting fluids of this invention. These additives include dispersants, antiwear agents, corrosion inhibitors, detergents, extreme pressure additives, and the like. They are typically disclosed in, for example, "Lubricant Additives" by C. V. Smalheer and R. Kennedy Smith, 1967, pp. 1–11 and U.S. Pat. No. 4,105,571.

Representative amounts of these additives in an ATF are summarized as follows:

| Additive | (Broad) Wt. % | (Preferred) Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |

-continued

| Additive | (Broad) Wt. % | (Preferred) Wt. % |
|---|---|---|
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.01–8 | 0.5–5 |
| Lubricating Oil | Balance | Balance |

The additive combinations of this invention may be combined with other desired lubricating oil additives to form a concentrate. Typically the active ingredient (a.i.) level of the concentrate will range from 20 to 90, preferably from 25 to 80, most preferably from 35 to 75 weight percent of the concentrate. The balance of the concentrate is a diluent typically comprised of a lubricating oil or solvent.

Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require each oil to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000–1500); and mono- and poly-carboxylic esters thereof (e.g., the acetic acid esters, mixed C3–C8 fatty acid esters, and C12 oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of C4 to C12 alcohols.

Esters useful as synthetic lubricating oils also include those made from C5 to C12 monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly HE oligomers of 1-decene.

The following examples are given as specific illustrations of the claimed invention. It should be understood, however, that the invention is not limited to the specific details set forth in the examples. All parts and percentages are by weight unless otherwise specified.

EXAMPLES

No standardized test exists for evaluating anti-shudder durability of automatic transmission fluids. Several test methods have been discussed in published literature. The methods all share a common theme, that is, continuously sliding a friction disk, immersed in a test fluid, at a certain set of conditions. At preset intervals the friction versus velocity characteristics of the fluid are determined. The common failing criteria for these tests is when dMu/dV (the change in friction coefficient with velocity) becomes negative, i.e., when increasing velocity results in lower friction coefficient. A similar method which is described below, has been used to evaluate the compositions of this invention.

Anti-Shudder Durability Test Method

An SAE No. 2 test machine fitted with a standard test head was modified to allow test fluid to be circulated from an external constant temperature reservoir to the test head and back. The test head is prepared by inserting a friction disk and two steel separator plates representative of the sliding torque converter clutch (this assembly is referred to as the clutch pack). Two liters of test fluid are placed in the heated bath along with a 32 $cm^2$ (5 in.2) copper coupon. A small pump circulates the test fluid from the reservoir to the test head in a loop. The fluid in the reservoir is heated to 145° C. while being circulated through the test head, and 50 ml./min. of air are supplied to the test head. The SAE No. 2 machine drive system is started and the test plate rotated at 180 rpm, with no apply pressure on the clutch pack. This break-in period is continued for one hour. At the end of one hour five (5) friction coefficient (Mu) versus velocity measurements are made. Then 6 dynamic engagements of 13,500 joules each are run, followed by one measurement of static breakaway friction. Once this data collection is accomplished a durability cycle is begun.

The durability cycle is run in approximately one hour segments. Each hour the system is "slipped" at 155° C., 180 rpm, and 10 $kg/cm^2$ for 50 minutes. At the end of the 50 minutes of slipping, twenty (20) 13,500 joule dynamic engagements are run. This procedure is repeated three more times, giving a four hour durability cycle. At the end of four hours, 5 Mu versus velocity measurements are made at 120° C. The dMu/dV for the fluid is calculated by averaging the 3rd, 4th, and 5th Mu versus velocity measurements and calculating dMu/dV by subtracting the Mu value at 0.35 m/s from the Mu value at 1.2 m/s and dividing by the speed difference, 0.85 m/s. For convenience the number is multiplied by 1000 to convert it to a whole number. A fluid is considered to have lost anti-shudder protection when the dMu/dV reaches a value of negative three (−3). The result is reported as "Hours to Fail". Several commercial ATF's which do not possess anti-shudder durability characteristics have been evaluated by this test method. They give "Hours to Fail" in the range of 15 to 25.

Example 1

Effect of Phosphorus Source

Eight (8) blends were prepared for anti-shudder durability evaluation by the foregoing procedure and are shown as Blends 1C to 8 in Table 1. The blends contain a conventional treat rate of a polymethacrylate viscosity modifier and were prepared in a conventional solvent refined neutral base oil with a kinenatic viscosity of approximately 4 cSt at 100° C. Blends 1C through 8 are made using an ashless dispersant with 950 molecular weight polyisobutylene alkyl chains. The eight blends contain various phosphorus sources, all treated to give 300 ppm of phosphorus in the fluid. Blend 1C is a comparative example, the phosphorus source in Blend 1C is a PIBSA/PAM (450 MW) material post-treated with phosphorus acid. It is not a phosphorus source of the current invention and is shown therefore as a comparative example. Blend 2 uses di-butyl hydrogen phosphite (structure V, R1=R2=$C_4H_9$). Blend 3 uses di-lauryl hydrogen phosphite (structure V, R1=R2=$C_{12}H_{25}$). Blend 4 uses tri-lauryl phosphite (structure VI, R1=R2 =R3=$C_{12}H_{25}$). Blend 5 uses triphenyl phosphite (structure VI, R1=R2=R3=$C_6H_5$). Blends 6, 7 and 8 uses a complex phosphite mixtures prepared as described in the contained examples, according to U.S. Pat. Nos. 5,185,090 and 5,242,612.

The test results in Table 1 show that all of the alkyl phosphites of the present invention provide better anti-shudder durability than the comparative example, Example 1C, which does not meet the criteria of the invention. The examples containing the preferred phosphites, Examples 6, 7 and 8 provide significantly better anti-shudder durability than the comparative example, Example 1C.

ing on Blends 11 and 12 was conducted on a different friction material, one that is much more difficult to provide anti-shudder durability on. Even in this more difficult case, the blend with the higher molecular weight dispersant, the dispersant of the current invention, provided almost double the anti-shudder durability of the lower molecular weight dispersant, i.e. 112 hours vs. 68 hours.

These examples clearly show that (1) the alkyl phosphites are superior to other sources of phosphorus for controlling shudder, and the most preferred phosphites are significantly superior to other phosphites; and (2) that the higher molecular weight dispersant of the current invention provides significantly improved anti-shudder durability with any phosphite and on any friction material.

The principles, preferred embodiments , and modes of operation of the present invention have been described in the foregoing specification. The invention which is intended to be protected herein, however, is not to be construed as limited to the particular forms disclosed, since these are to be regarded as illustrative rather than instructive. Variations and changes may be made by those skilled in the art without departing from the spirit of the invention.

TABLE 1

Effect of Phosphorus Source

| Component | Product of Example | 1C | 2 | 3 | 4 | 5 | 6 | 7 | 8 |
|---|---|---|---|---|---|---|---|---|---|
| Borated PIBSA/PAM Dispersant (950 MW) | D-1 | 3.50 | 3.50 | 3.50 | 3.50 | 3.25 | 3.50 | 3.50 | 3.50 |
| Diphenylamine anti-oxidant | — | 0.30 | 0.30 | 0.30 | 0.30 | 0.30 | 0.30 | 0.30 | 0.30 |
| Hindered phenol anti-oxidant | — | 0.50 | 0.50 | 0.50 | 0.50 | 0.50 | 0.50 | 0.50 | 0.50 |
| Tolyltriazole | — | 0.05 | 0.05 | 0.05 | 0.05 | 0.05 | 0.05 | 0.05 | 0.05 |
| 300 TBN Ca Sulfonate | — | 0.10 | 0.10 | 0.10 | 0.10 | 0.10 | 0.10 | 0.10 | 0.10 |
| Low Treat Friction Modifier | FM-1 | 2.50 | 2.50 | 2.50 | 2.50 | 2.50 | 2.50 | 2.50 | 2.50 |
| 450 MW PIBSA/PAM post treated with H3PO3 | — | 1.17 | — | — | — | — | — | — | |
| Dibutyl hydrogen phosphite | — | — | 0.19 | — | — | — | — | — | — |
| Dilauryl hydrogen phosphite | — | — | — | 0.41 | — | — | — | — | — |
| Trilauryl hydrogen phosphite | — | — | — | — | 0.57 | — | — | — | — |
| Triphenyl phosphite | — | — | — | — | — | 0.30 | — | — | — |
| Mixed alkyl phosphites | P-1 | — | — | — | — | — | 0.58 | — | — |
| Mixed alkyl phosphites | P-2 | — | — | — | — | — | — | 0.45 | — |
| Mixed alkyl phosphites (Polyisobutylene Molecular Weight) | P-3 | — | — | — | — | — | — | — | 0.35 |
| Results | | | | | | | | | |
| Friction Material | | 1 | 1 | 1 | 1 | 1 | 1 | 1 | 1 |
| Hours to Fail | | 120 | 144 | 160 | 128 | 148 | 136 | 204 | 148 |

Example 2

The Effect of Dispersant Molecular Weight

Four additional blends were prepared as above and subjected to the previously described anti-shudder durability test method. The composition of the four blends is shown in Table 2. The blends in Table 2 demonstrate the dramatic effect of dispersant alkyl group molecular weight with two different phosphorus sources and with two different friction materials. Blends 9 and 10 are prepared with trilauryl trithiophosphite, not a phosphite of the current invention. Blend 10 with the dispersant of the current invention (alkyl chain molecular weight of 2225) gives almost double the anti-shudder durability of Blend 9 with the lower molecular weight dispersant (2225 MW vs. 950 MW). Blends 11 and 12 are prepared with the preferred alkyl phosphites of the current invention and also differ in the molecular weight of the ashless dispersant used. However, the anti-shudder testing on Blends 11 and 12 was conducted on a different friction material, one that is much more difficult to provide anti-shudder durability on. Even in this more difficult case, the blend with the higher molecular weight dispersant, the dispersant of the current invention, provided almost double the anti-shudder durability of the lower molecular weight dispersant, i.e. 112 hours vs. 68 hours.

TABLE 2

Effect of Dispersant Molecular Weight

| Component | Product of Example | 9 | 10 | 11 | 12 |
|---|---|---|---|---|---|
| Borated PIBSA/PAM Dispersant (950 MW) | D-1 | 3.25 | — | 3.25 | — |
| Borated PIBSA/PAM Dispersant (2225 MW) | D-2 | — | 3.25 | — | 3.25 |
| Diphenylamine anti-oxidant | — | 0.30 | 0.30 | 0.30 | 0.30 |
| Hindered phenol anti-oxidant | — | 0.50 | 0.50 | 0.50 | 0.50 |
| Tolyltriazole | — | 0.05 | 0.05 | 0.05 | 0.05 |
| Mixed mono & di-nonylthio DMTD* | — | — | — | 0.05 | 0.05 |
| 300 TBN Ca Sulfonate | — | 0.50 | 0.50 | 0.10 | 0.10 |
| Low Treat Friction Modifier | FM-2 | 3.00 | 3.00 | 3.00 | 3.00 |
| Trilauryl Trithiophoshite | — | 0.60 | 0.60 | | |

TABLE 2-continued

Effect of Dispersant Molecular Weight

| Component | Product of Example | 9 | 10 | 11 | 12 |
|---|---|---|---|---|---|
| Mixed alkyl phosphites (Poly isobutylene molecular weight) | P-3 | — | — | 0.35 | 0.35 |
| Results | | | | | |
| Friction Material | | 1 | 1 | 2 | 2 |
| Hours to Fail | | 92 | 168 | 68 | 112 |

*HITEC 4313, available from Ethyl Corp.

What is claimed is:

1. A power transmitting fluid composition comprising:

(1) a major amount of a lubricating oil, and (2) an anti-shudder improving effective amount of an additive combination comprising:

(a) a reaction product of an isomerized alkenyl substituted succinic anhydride and a polyamine characterized by structure (I), where structure (I) is:

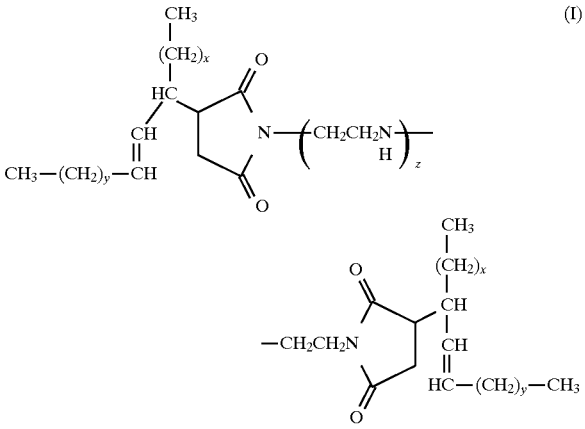

(I)

where:

x and y are independent integers whose sum is from 1 to 30, and z is an integer from 1–10;

or the alkyl analog thereof, (b) an oil-soluble alkyl phosphite;

(c) an ashless dispersant with alkyl sidechains of greater than about 1800 molecular weight; and (d) a nitrogen containing corrosion inhibitor.

2. A power transmitting fluid composition comprising:

(1) a major amount of a lubricating oil, and (2) an anti-shudder improving effective amount of an additive combination comprising:

(a) a reaction product of an isomerized alkenyl substituted succinic anhydride and a polyamine characterized by structure (I), where structure (I) is:

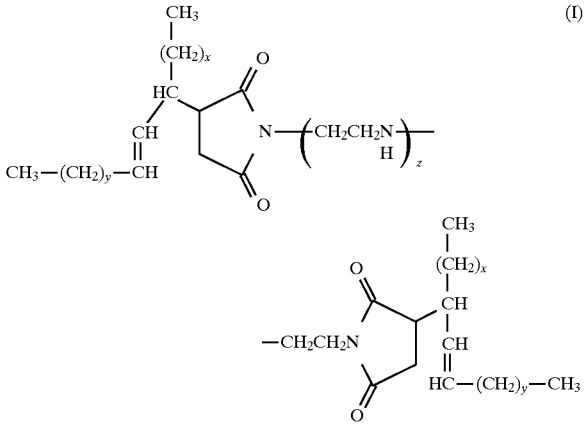

(I)

where:

x and y are independent integers whose sum is from 1 to 30, and z is an integer from 1–10;

or the alkyl analog thereof, (b) an oil-soluble alkyl phosphite;

(c) an ashless dispersant with alkyl sidechains in the range of 1800 to 5000 molecular weight; and (d) a nitrogen containing corrosion inhibitor.

3. The composition of claim 2, wherein the ashless dispersant has sidechains in the range of 1800 to 3000 molecular weight.

4. The composition of claim 3, wherein the ashless dispersant has sidechains in the range of 2000 to 3000 molecular weight.

5. The composition of claim 2, wherein the ashless dispersant has sidechains in the range of 2250–5000 molecular weight.

6. The composition of claim 5, wherein the ashless dispersant has sidechains of about 2250 molecular weight.

7. The composition of claim 2, which additionally contains a metallic detergent.

8. The composition of claim 7, where the metallic detergent is overbased calcium sulfonate.

9. The composition of claim 7, where the sum of x+y is from 13 to 15.

10. The composition of claim 9, where the metallic detergent is overbased calcium sulfonate.

11. The composition of claim 2, where the alkyl phosphite is prepared from an alkyl phosphite and an alcohol produced by ethoxylating an alkyl mercaptan.

12. The composition of claim 2, where the fluid is an automatic transmission fluid.

13. The composition of claim 2, where the nitrogen containing corrosion inhibitor is selected from the group consisting of benzotriazole and tolytriazole.

14. A process for producing the composition of claim 2, wherein the additive combination is premixed at elevated temperatures.

15. An additive concentrate composition comprising:

(a) a reaction product of an isomerized alkenyl substituted succinic anhydride and a polyamine characterized by structure (I), where structure (I) is:

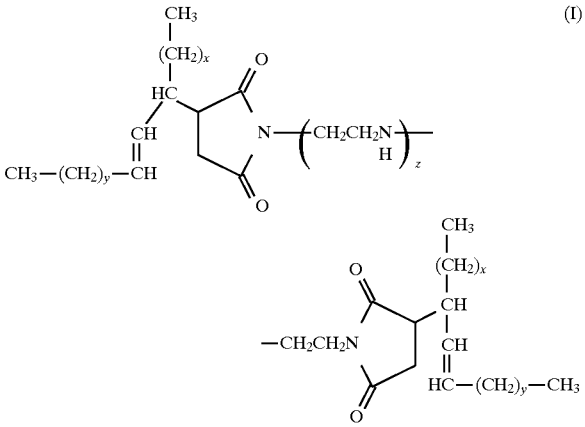

(I)

where:

x and y are independent integers whose sum is from 1 to 30, and z is an integer from 1–10;

or the alkyl analog thereof, (b) an oil-soluble alkyl phosphite;

(c) an ashless dispersant with alkyl sidechains of 1800 to 5000 molecular weight; and (d) a nitrogen containing corrosion inhibitor.

16. A method of improving the anti-shudder durability of a power transmitting fluid by incorporating into the fluid an anti-shudder durability improving effective amount of the additive concentrate of claim 15.

* * * * *